US012157614B2

(12) United States Patent
Bouteloup et al.

(10) Patent No.: US 12,157,614 B2
(45) Date of Patent: Dec. 3, 2024

(54) STOPPER DESIGNED TO CONTAIN A FLUID

(71) Applicant: CORADIN SAS, Mouans-Sartoux (FR)

(72) Inventors: David Bouteloup, Peymeinade (FR); Fabrice Bourdier, Montauroux (FR); Florence Bidamant, Mulhouse (FR)

(73) Assignee: CORADIN SAS

( * ) Notice: Subject to any disclaimer, the term of this patent is extended or adjusted under 35 U.S.C. 154(b) by 81 days.

(21) Appl. No.: 17/909,297

(22) PCT Filed: Mar. 25, 2021

(86) PCT No.: PCT/FR2021/050524

§ 371 (c)(1),
(2) Date: Sep. 2, 2022

(87) PCT Pub. No.: WO2021/191570

PCT Pub. Date: Sep. 30, 2021

(65) Prior Publication Data

US 2023/0042325 A1 Feb. 9, 2023

(30) Foreign Application Priority Data

Mar. 26, 2020 (FR) ..... 2003000

(51) Int. Cl.
*B65D 51/28* (2006.01)

(52) U.S. Cl.
CPC ..... *B65D 51/2807* (2013.01); *B65D 2205/02* (2013.01)

(58) Field of Classification Search
CPC ..... B65D 83/0094; B65D 83/0033; B65D 81/3205; B65D 21/0238; B65D 51/2892; B65D 51/2807

(Continued)

(56) References Cited

FOREIGN PATENT DOCUMENTS

GB 2559453 * 8/2018 ..... B65D 81/32
GB 2559453 A 8/2018

(Continued)

OTHER PUBLICATIONS

International Search Report for International Application No. PCT/FR2021/050524 (Oct. 4, 2021).

*Primary Examiner* — Anthony D Stashick
*Assistant Examiner* — Raven Collins
(74) *Attorney, Agent, or Firm* — Jenkins, Taylor & Hunt, P.A.

(57) ABSTRACT

The present invention relates to a cap (1) for sealing the restrictor (51) of a container (50), such as a flask or a bottle, the cap (1) being suitable for containing a fluid, said cap comprising at least a first part (10) and a second part (20), said first and second parts (10, 20) delimiting a chamber (15) for receiving said fluid, said first and second parts (10, 20) being movable, by means of displacement, from a first, initial position of the cap (1), for containing said fluid in said chamber (15), to a second, final position of said cap (1), in order to evacuate, by means of said displacement, said fluid from said chamber (15) of the cap (1), to allow said cap (1) to transfer the fluid into the container (50) when the cap (1) is positioned on the container (50), said cap (1) comprising an additional element (30) movable from a first position, which is suitable for allowing the evacuation of air from the container (50), to a second position which is suitable, together with said first part (10) and/or second part (20) of the cap (1), for sealing said restrictor (51) of the container (50).

9 Claims, 4 Drawing Sheets

(58) Field of Classification Search
USPC ..... 206/221
See application file for complete search history.

(56) References Cited

FOREIGN PATENT DOCUMENTS

| | | | |
|---|---|---|---|
| KR | 20090130939 | A | 12/2009 |
| KR | 201200927824 | A | 8/2012 |
| WO | WO 2018/162850 | A1 | 9/2018 |

* cited by examiner

[Fig. 1]
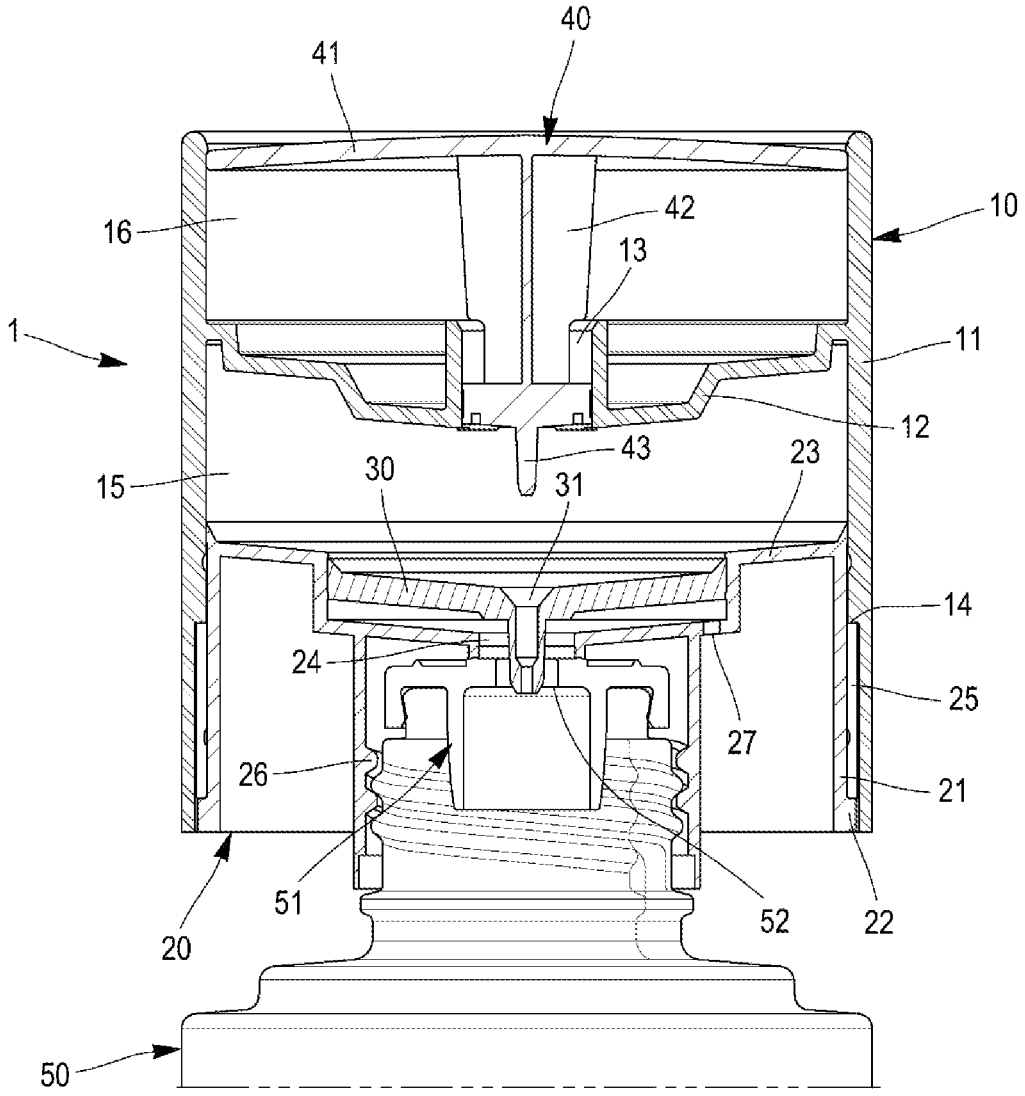

[Fig. 2]
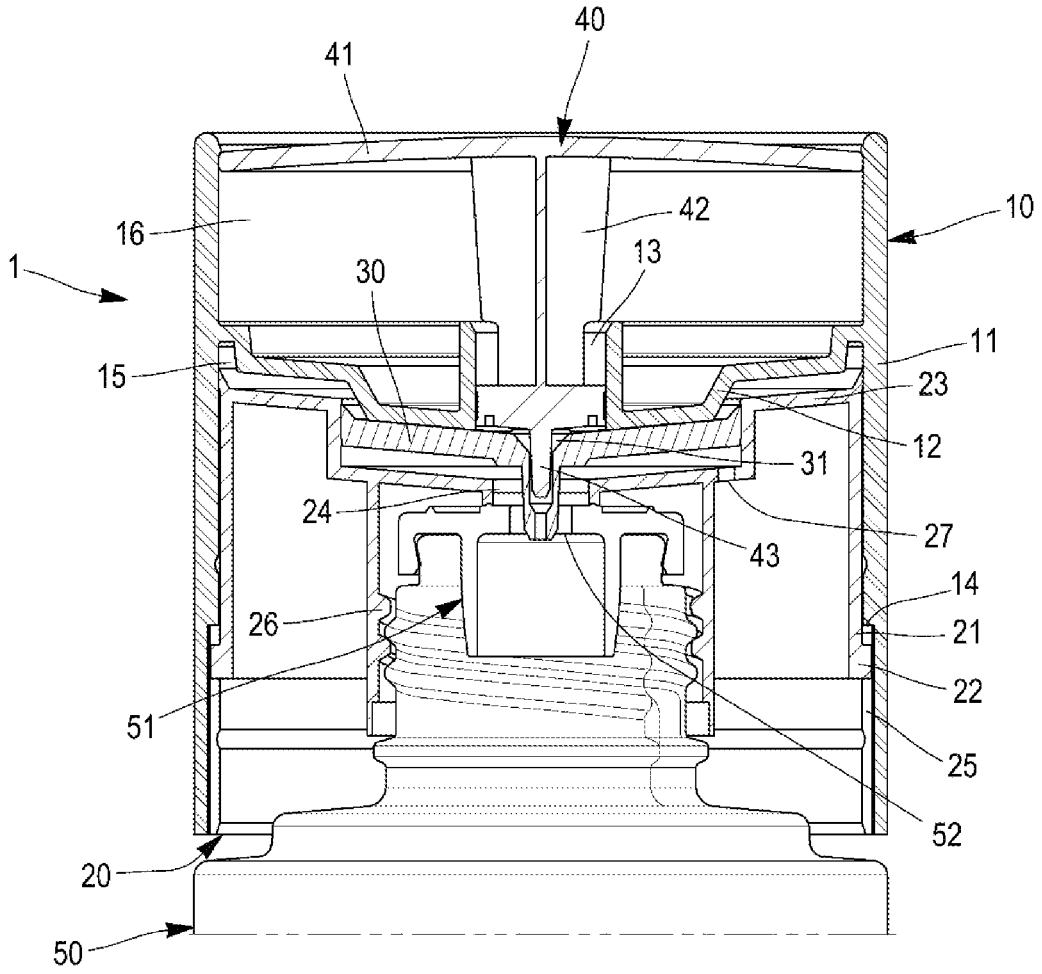

[Fig. 3]
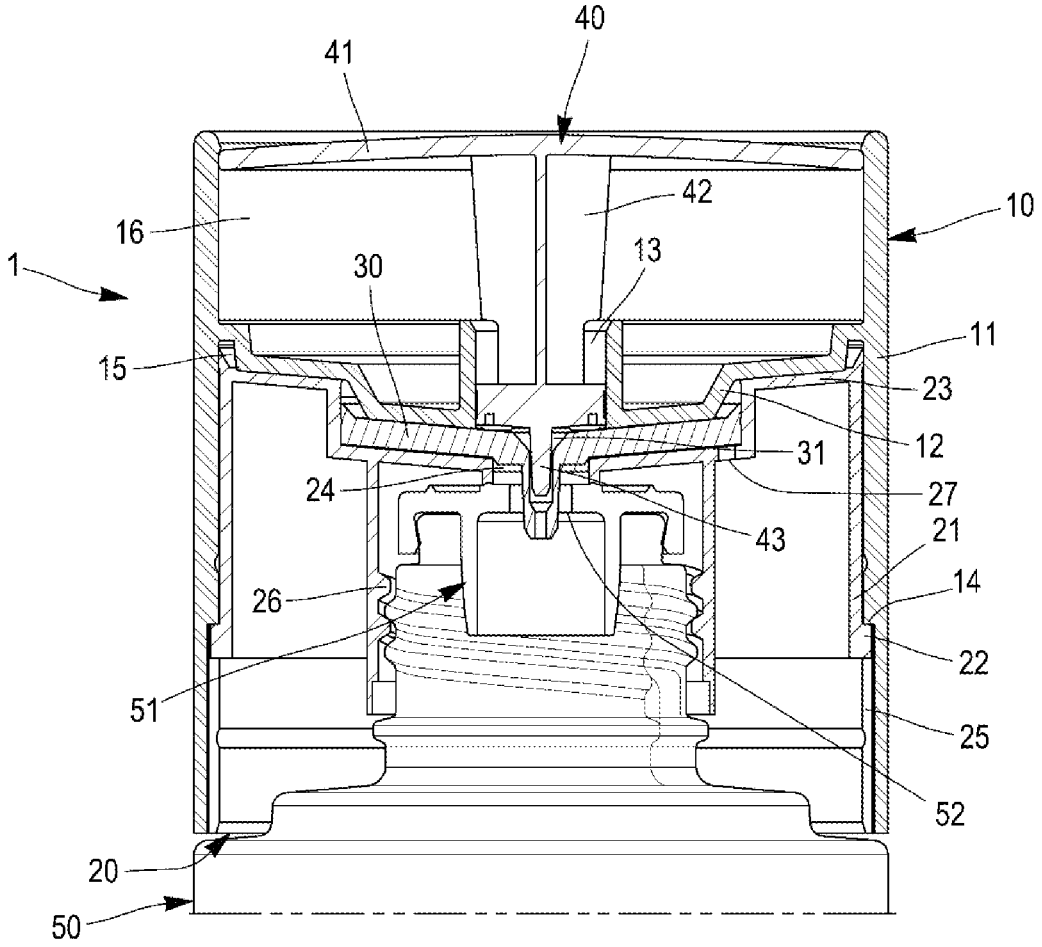

[Fig. 4]
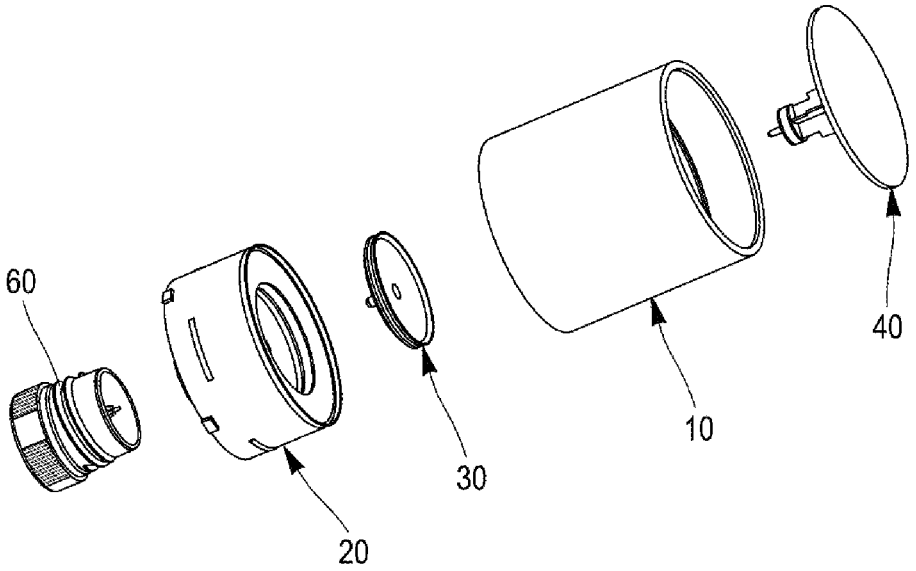
[Fig. 5]
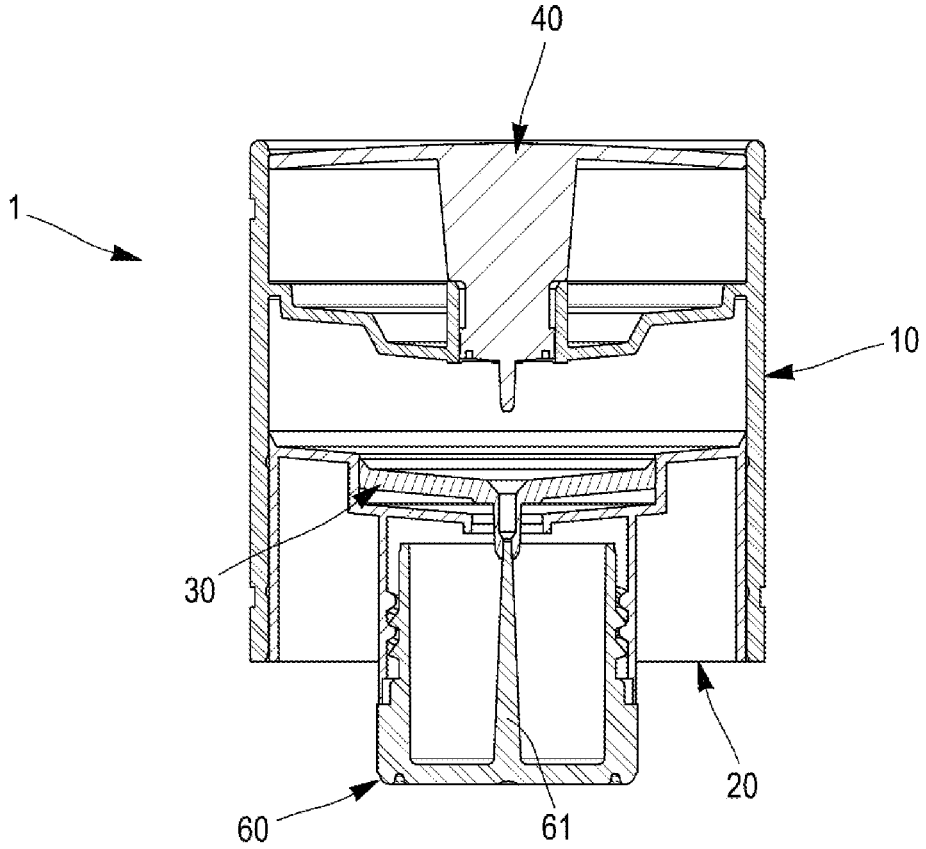

STOPPER DESIGNED TO CONTAIN A FLUID

FIELD OF THE INVENTION

The invention relates to a cap for sealing the restrictor of a container, such as a flask or a bottle, the cap being suitable for containing a fluid, said cap comprising at least a first part and a second part, said first and second parts delimiting a chamber for receiving said fluid.

STATE OF THE ART

In the state of the art, the use of a space available inside a cap is known, said space making it possible to contain a fluid which can enter into the container on which the cap is positioned at a precise moment chosen by the user.

It is usual for the container to hold a first fluid, with the cap holding a second fluid that is different from the first fluid contained in the container. If the user wishes to use the contents of the container, he/she, in the first instance, is able to release the second fluid contained in the cap into the container, thus allowing mixing of the first fluid, which is already present inside said container, and said second fluid.

A solution of this type is particularly suitable for hygiene and cosmetic pharmaceutical applications, where it is important to use a mixture of products directly after the mixing has been performed.

Caps containing a fluid which can be transferred from the cap to the container on which said cap is fixed are also used for food applications.

It is appropriate to note that the optimal transfer of a fluid contained in a cap to a container on which said cap is fixed may be compromised. Indeed, the air present inside the container may not be expelled outwards during the transfer of the fluid from the cap to the container. Since the primary function of the cap consists in sealing the container outlet, the air may not be expelled and the transfer of the fluid between the cap and the container is not optimal.

For the reasons set out above, there is a need to propose novel solutions which make it possible to remedy this fault. The aim of the present invention consists in providing a cap of the type as identified above, allowing the air present inside a container to be able to be expelled from said container during the transfer of the fluid contained inside a cap into said container.

OBJECT OF THE INVENTION

The present invention relates to a cap for sealing the restrictor of a container, such as a flask or a bottle, the cap being suitable for containing a fluid, said cap comprising at least a first part and a second part, said first and second parts delimiting a chamber for receiving said fluid, said first and second parts being movable, by means of displacement, from a first, initial position of the cap, for containing said fluid in said chamber, to a second, final position of said cap in order to evacuate, by means of said displacement, said fluid from said chamber of the cap to allow said cap to transfer the fluid into the container when the cap is positioned on the container, said cap comprising an additional element movable from a first position, which is suitable for allowing evacuation of air from the container, to a second position that is suitable, together with said first and/or second part of the cap, for sealing said restrictor of the container.

According to one embodiment of the invention, the additional element is situated in its first position, at the start of said displacement, and in its second position at the end of said displacement.

According to one embodiment of the invention, the second part of the cap is equipped with fixing means, such as a thread, for fixing said cap on said container by means of said fixing means, wherein the additional element is movably connected to said second part of the cap.

According to one embodiment of the invention, the additional element is equipped with a conduit with a first end directed toward the chamber for containing a fluid and acting as an inlet opening, and with a second directed end acting as an outlet opening, said second end being suitable for pouring the fluid when the cap is positioned on the container in the container.

According to one embodiment of the invention, the first part of the cap comprises a first wall essentially perpendicular to the direction of said displacement and wherein the second part of said cap comprises a second wall essentially perpendicular to the direction of said displacement, wherein the chamber is delimited by the combination of said first and second walls.

According to one embodiment of the invention, said second wall comprises a housing suitable for movably fixing the additional element.

According to one embodiment of the invention, said housing comprises an opening or valve, wherein said opening or valve is opened if the additional element is situated in its first position, and closed if said additional element is situated in its second position.

According to one embodiment of the invention, said first wall and/or a member connected to said first wall is suitable for coming into contact with the additional element during said displacement of said first and second parts of the cap, wherein said additional element is displaced from its first position to its second position by means of said first wall and/or a member connected to said first wall being pushed against the additional element during said displacement.

According to one embodiment of the invention, the cap comprises a protuberance connected to said first wall, said protuberance being suitable for sealing said conduit of the additional element, in the second, final position of the cap.

According to a second aspect of the invention, the invention relates to an assembly made up of a container and a cap.

BRIEF DESCRIPTION OF THE DRAWINGS

The aim, object and characteristics of the invention will become more clearly apparent on reading the following description with reference to the figures, in which:

FIG. 1 shows a sectional view of a cap according to the invention, said cap being positioned on the upper part of a container, the cap being shown in a first, initial position, FIG. 2 depicts a sectional view of the cap according to FIG. 1, in an intermediate position, FIG. 3 illustrates a sectional view of the cap according to FIGS. 1 and 2, in a second, final position, FIG. 4 shows an exploded and schematic view of the cap assembly according to the present invention, and FIG. 5 depicts a sectional view of the cap according to the invention, in its first, initial position in which said cap is sealed by means of a protection element.

FIG. 1 shows a sectional view of a cap 1 according to the present invention. Said cap 1 is suitable for containing (as described in more detail below) a fluid and suitable for evacuating said fluid into a container (50) on which said cap 1 is fixed.

FIG. 1 depicts the cap 1, said cap 1 being fixed on the end of a bottle-shaped container 50. The container 50 is equipped with a restrictor 51 which is positioned in the opening of the container 50 and makes it possible to create a restrictor for said container 50. As shown in FIG. 1, the cap 1 is fixed on the container 50 by virtue of a thread.

The cap 1 comprises a chamber 15 suitable for containing a fluid. For the sake of clarity, the fluid is not depicted in FIG. 1. The chamber 15 is delimited by the assembly made up of a first part 10 of the cap 1 and of a second part 20 of said cap 1. In FIG. 1, the first part 10 and the second part 20 are depicted in a first, initial position in which the cap 1 is suitable for containing a fluid. As explained in more detail with reference to FIGS. 2 and 3, in the position as shown in FIG. 1, the first part 10 and the second part 20 are movable, from said first, initial position depicted in FIG. 1 which makes it possible to contain a fluid, to a second, final position which makes it possible to evacuate said fluid from the chamber 15.

Once the fluid contained in the chamber 15 is evacuated out of the cap 1, it is introduced into the container 50 and enters into said container via the restrictor 51 which is fixed on the opening of the container 50. During the evacuation process, and in order to optimise evacuation of the fluid out of the chamber 15, via the cap 1, to inside the container 50, a quantity of air of equivalent volume to the volume occupied by the fluid contained inside the cap 1 must be evacuated from the chamber 15 in order to allow the entry of said fluid into the container (50). In order to optimise the evacuation of air out of the container 50, during the introduction of the fluid exiting from the cap 1, said cap 1 is equipped with an additional element 30. Said additional element 30 is movable from a first position, as shown in FIG. 1, to allow the evacuation of air out of the container 50, to a second position, as shown in FIG. 3, in which said additional element 30 is suitable for sealing the opening of the restrictor 51 of the container 50.

The various components of the cap 1 are described in more detail below.

The first part 10 of the cap 1 comprises a first element 11, which is essentially cylindrical in shape, which forms the outer wall of said cap 1. A wall 12 is fixed onto the first element 11, essentially perpendicular to said first element 11. As shown in FIG. 1, said wall 12 delimits the chamber 15 which is suitable for containing a fluid. Said wall 12 comprises an opening 13 which makes it possible to provide a through part of a support element 40. The support element 40, used for production reasons, allows the upper part inside the cap 1 to remain empty without having the need to fill the space 16 with substance, said space 16 being situated around the support element 40 and inside the wall 11. Furthermore, the presence of such a support element 40 allows the chamber 15 to be filled. The withdrawal of the support element 40 provides a passage for filling said chamber 15, said passage being sealed once said support element is installed in its final position as shown in FIG. 1.

The support element 40 comprises two parts, the first part of the support element 40 is equipped with a wall 41 forming the upper part of the cap 1. A user may, by means of the wall 41, exert pressure with the palm of his/her hand, for example, onto the upper part of the cap 1, thus bringing about a relative displacement between the first part 10 and the second part 20 of said cap 1. To perform this movement, the user may, for example, position the container 50 on a support and push the wall 41 toward said container 50 with his/her hand.

The second part of the support element 40 is equipped with a longitudinal element 42, the end of which includes a protuberance 43. Said protuberance 43 extends from the wall 12 to the additional element 30.

The second part 20 of the cap 1 is equipped with a wall 21, which is essentially cylindrical and which is suitable to be positioned inside the wall 11 of the first part 10 of said cap 1. As illustrated in FIG. 1, the lower part of the wall 21 is equipped with a shoulder 22 which is suitable for cooperating with a shoulder 14 on the wall 11 of the first part 10 where a free space 25 is delimited between said shoulder 22 and said shoulder 14, when the cap 1 is in the first, initial position. The wall 21 of the second part 20 of the cap 1, fixed against the inside of the wall 11 of the first part 10 of the cap 1, makes it possible to prevent the parts from being inadvertently displaced if no pressure is exerted on the outside of the first part 10 of the cap 1. However, the fixture between the outside of the wall 21 of the second part 20 of the cap 1 and the inside of the wall 11 of the first part 10 of said cap 1 allows the walls 11, 21 to be displaced relative to one another once pressure is exerted on the outside of said first part 10 of said cap 1, with the aim of displacing said first part 10 relative to the second part 20 of the cap 1.

The second part 20 of the cap 1 comprises a wall 23 which extends perpendicularly relative to the wall 21 of said second part 20 of said cap 1. Said wall 23 delimits a housing which makes it possible to receive the additional element 30, as depicted in FIG. 1. The wall 23 comprises an opening 24 suitable for being aligned with the opening 52 of the restrictor 51 of the container 50. The wall 23 is equipped with an element 26 which is essentially cylindrical in shape and which comprises a fixing means such as a thread, which makes it possible to fix the second part 20 of the cap 1 on the upper end of the container 50.

The additional element 30 is fixed inside the housing delimited by the wall 23, as depicted in FIG. 1. The additional element 30 may be displaced from a first position as shown in FIG. 1, to a second position as shown in FIG. 3, relative to the wall 23 of the second part 20 of the cap 1. This displacement is possible provided that the value of the pressure exerted on the additional element 30 toward the container 50 reaches a determined threshold value. As illustrated in FIG. 1, the additional element 30 comprises a conduit 31 suitable for allowing the fluid contained in the chamber 15 to be expelled into the container 50.

With reference to FIGS. 1, 2, 3, the operation and coordination of the movements of the first part 10 of the cap 1, which is equipped with the support element 40, relative to the movements of the second part 20 of said cap 1, which is equipped with the additional element 30, is described below.

With reference to FIG. 1, the cap 1 is firstly fixed on the upper end of the container 50. The second part 20 of said cap 1 comes into contact with the restrictor 51 of said container 50 so that the conduit 31 of the additional element 30 is positioned inside the opening 52 of the restrictor 51 of the container 50. When the cap 1 is thus fixed on the container 50, this can be used to evacuate the fluid contained within the chamber 15 into said container 50. To do this, the user must exert pressure on the outside of the wall 11 of the first part 10, or on the wall 41 of the support element 40, or on both simultaneously, in order to displace said first part 10 of the cap 1 relative to the second part 20 of the cap 1 toward the inside of the container 50.

FIG. 2 shows the chamber 15 which has a smaller volume than the volume depicted in FIG. 1, which means that in the position illustrated in FIG. 2, the fluid contained in the chamber 15 has been transferred into the container 50, expelled from said chamber 15 via the conduit 31 of the additional element 30. It should be noted that the wall 23 is equipped with an opening or valve 27 which allows the air present inside the container 50 to be evacuated out of said container 50 during the transfer of the fluid from the chamber 15 to said container 50. The pathway of the air is such that the air is evacuated from the container 50, via the opening 52 of the restrictor 51 of the container 50, and is displaced between the wall 23 of the second part 20 of the cap 1 and the additional element 30 toward the opening or valve 27. The air evacuation facilitates the introduction of the fluid expelled from the chamber 15 to the inside of the container 50. As depicted in FIG. 2, during the first phase of evacuation of the liquid from the chamber 15 to the inside of the container 50, the additional element 30 is not displaced. The pathway of the air expelled from the container 50 remains possible by virtue of the distance between the additional element 30, the wall 23 and the presence of the opening or valve 27. This means that the fixing of the additional element 30 inside its housing on the wall 23 is therefore appropriate for withstanding the hydraulic pressure resulting from the expulsion of the fluid from the chamber 15 toward the inside of the container 50. In other words, the force exerted by the first part 10 of the cap 1 on the second part 20 of said cap 1 is not sufficiently great to exceed the threshold value of the force exerted on the additional element 30 and bring about its displacement relative to its housing situated in the wall 23 of the second part 20 of the cap 1.

FIG. 2 shows that, during movement of the first part 10 to the second part 20 of the cap 1, the wall 12 of the first part 10 and the end of the longitudinal element 42 of the support element 40 come into physical contact with the additional element 30. This contact between the various elements described above is illustrated in FIG. 2. Once said various elements have come into contact, the displacement of the first part 10 of the cap 1 toward the second part 20 of said cap 1 continues, thus causing the movement of the additional element 30 toward the restrictor 51 of the container 50.

FIG. 3 schematically illustrates the final position of the first part 10 and of the second part 20 of the cap 1, as well as that of the additional element 30. In this final position, the assembly made up of the first part 10, the second part 20 and the additional element 30 is suitable to ensure optimal sealing of the opening 52 of the restrictor 51 of the container 50. The conduit 31 situated inside the additional element 30 has been, at least partly, filled by means of the protuberance 43 of the longitudinal element 42 of the support element 40, in order to prevent the fluid from leaking from the container 50 into the cap 1.

It should furthermore be noted that the opening or valve 27 of the wall 23 is sealed, in the final position, by means of the additional element 30.

The presence of the first part 10 and of the second part 20 of the cap 1, in collaboration with the support element 40 and the additional element 30, as described above, allows optimal emptying of the chamber 15. It also allows the fluid contained in said chamber 15 to be transferred toward the inside of the container 50, while ensuring expulsion of the air present in said container 50 toward the outside during the transfer of said fluid.

FIG. 4 depicts an exploded and schematic view of the cap 1 assembly according to the present invention. The additional element 30 is positioned inside the housing provided in the second part 20 of the cap 1. The support element 40 is fixed inside the first part 10 of said cap 1. The assembly made up of the second part 20 and the additional element 30 is fixed inside the first part 10 of said cap 1. In addition to the elements already described in FIGS. 1, 2 and 3, FIG. 4 furthermore shows a sealing element 60. Said sealing element 60 may serve to protect the inside of the wall 26 of the second part 20 of the cap 1, as well as the additional element 30 during transporting and handling of said cap 1 before it is finally fixed on the container 50.

FIG. 5 shows a schematic view of the assembly of elements 10, 20, 30, 40 and 60, as illustrated in FIG. 4. FIG. 5 illustrates the sealing element 60, the inside of which is equipped with a sealing piece 61 suitable for coming into contact with the inside of the conduit 31 of the additional element 30. The use of the sealing piece 61 allows the sealing element 60 to protect, at least partly, the inside of the conduit 31 of the additional element 30. Furthermore, the presence of the sealing piece 61 prevents any potential intentional leak of the fluid contained in the chamber 15 to the outside of the container 50.

The various elements 10, 20, 30, 40 and 60, which together form the cap 1 according to the present invention, are made of a suitable substance. As an indication, the first part 10 of the cap 1 can be made from polypropylene. This substance may be a PCR (Post Consumer Recycled) polypropylene.

The second part 20 of the cap 1 may contain polyethylene. As an indication, said polyethylene may be an HD (High Density) polyethylene.

The additional element 30 may also contain polyethylene. As an indication, said polyethylene may be an LD (Low Density) polyethylene.

The sealing element 60 may contain polypropylene. As an indication, said polypropylene may be a PCR (Post Consumer Recycled) polypropylene.

The invention claimed is:

1. A cap (1) for sealing a restrictor (51) of a container (50), such as a flask or a bottle, the cap (1) being suitable for containing a fluid, said cap (1) comprising at least a first part (10) and a second part (20), said first and second parts (10, 20) delimiting a chamber (15) for receiving said fluid, said first and second parts (10, 20) being movable, by means of displacement, from a first, initial position of the cap (1), for containing said fluid in said chamber (15), to a second, final position of said cap (1), in order to evacuate, by means of said displacement, said fluid from said chamber (15) of the cap (1), to allow said cap (1), when the cap (1) is positioned on the container (50), to transfer the fluid to the container (50), characterised in that the cap (1) comprises an additional element (30) movable from a first position within the cap (1), said first position being suitable for allowing the evacuation of air from the container (50) to a second position within the cap (1), said second position being suitable, together with said first (10) and/or second (20) part of the cap (1), for sealing said restrictor (51) of the container (50), wherein the additional element (30) is situated, in its first position, at the start of said displacement of said first and second parts (10, 20) of the cap (10), and, in its second position, at the end of said displacement of said first and second parts (10, 20) of the cap (1).

2. The cap (1) according to claim 1, wherein the second part (20) of the cap (1) is equipped with fixing means, such as a thread, for fixing said cap (1) on said container (50) by means of said fixing means, wherein the additional element (30) is movably connected to said second part (20) of the cap (1).

3. The cap (1) according to claim 1, wherein the additional element (30) is equipped with a conduit with a first end directed toward the chamber (15) for containing a fluid and acting as an inlet opening, and with a second directed end acting as an outlet opening, said second end being suitable for pouring the fluid when the cap (1) is positioned on the container (50) in the container (50).

4. The cap according to claim 1, wherein the first part (10) of the cap (1) comprises a first wall essentially perpendicular to the direction of said displacement, and wherein the second part (20) of said cap (1) comprises a second wall essentially perpendicular to the direction of said displacement, wherein the chamber (15) is delimited by the combination of said first and second walls.

5. The cap (1) according to claim 4, wherein said second wall comprises a housing suitable for movably fixing the additional element (30).

6. The cap (1) according to claim 5, wherein said housing comprises an opening or valve, wherein said opening or said valve is opened if the additional element (30) is situated in its first position, and closed if said additional element (30) is situated in its second position.

7. The cap (1) according to claim 4, wherein said first wall and/or a member connected to said first wall is suitable for coming into contact with the additional element (30) during said displacement of said first and second parts (10, 20) of the cap (1), wherein said additional element (30) is displaced from its first position to its second position by means of said first wall and/or a member connected to said first wall being pushed against the additional element (30) during said displacement.

8. The cap (1) according to claim 3, wherein the cap (1) comprises a protuberance connected to said first wall, said protuberance being suitable for sealing said conduit of the additional element (30), in the second, final position of the cap (1).

9. A container (50) and cap (1) assembly according to claim 1.

* * * * *